United States Patent [19]

Dgetluck

[11] Patent Number: 4,492,350

[45] Date of Patent: Jan. 8, 1985

[54] PACKAGING REEL

[75] Inventor: John Dgetluck, Wilbraham, Mass.

[73] Assignee: Pioneer Packaging, Inc., Chicopee, Mass.

[21] Appl. No.: 542,545

[22] Filed: Oct. 17, 1983

[51] Int. Cl.[3] ..... B65H 75/06; B65H 75/14

[52] U.S. Cl. ..... 242/118.4; 242/222; 242/118.8

[58] Field of Search ..... 242/50, 61, 118.4, 118.41, 242/118.8, 222, 71.8; 206/389, 395, 396

[56] References Cited

U.S. PATENT DOCUMENTS

| | | | |
|---|---|---|---|
| 1,052,303 | 2/1913 | Aven | 242/118.8 |
| 2,368,594 | 1/1945 | Hawkins | 242/71.8 |
| 2,413,966 | 1/1947 | Greisman | 242/118.7 |
| 2,477,333 | 7/1949 | Hawkins | 242/71.8 |
| 2,559,056 | 7/1951 | Weiss | 242/118.7 |
| 3,104,077 | 9/1963 | Struble | 242/118.8 |
| 3,838,602 | 10/1974 | Hanson et al. | 242/118.8 |
| 3,971,527 | 7/1976 | Maye | 242/118.7 |
| 4,019,692 | 4/1977 | Hanson | 242/71.8 |
| 4,437,618 | 3/1984 | Boyle | 242/71.8 |

*Primary Examiner*—Leonard D. Christian

*Attorney, Agent, or Firm*—Robert T. Gammons

[57] ABSTRACT

A reel comprising spaced, parallel flanges between which is disposed a hub wherein the flanges comprise first and second outer side wall panels and the hub first and second longitudinal hub panels positioned between the first and second outer side wall panels at right angles thereto and reinforced panels disposed at the inner sides of the first and second outer side wall panels, said panels being so associated as to be formed of a single sheet of cardboard and to be folded to form a reel wherein the flanges of the reel are of no more than two ply thickness.

12 Claims, 11 Drawing Figures

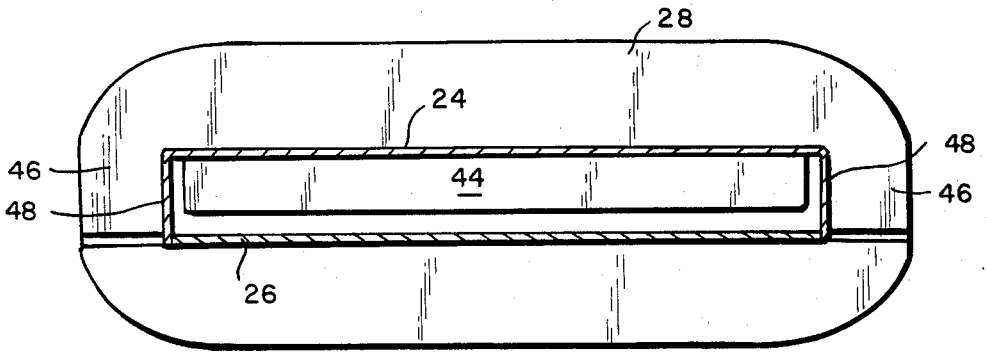
FIG.5
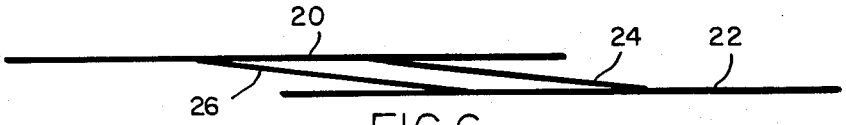
FIG.6
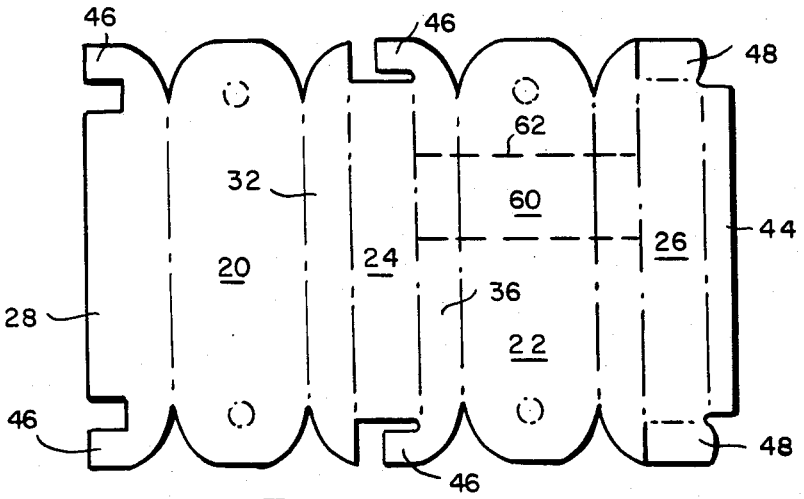
FIG. 7
FIG.8
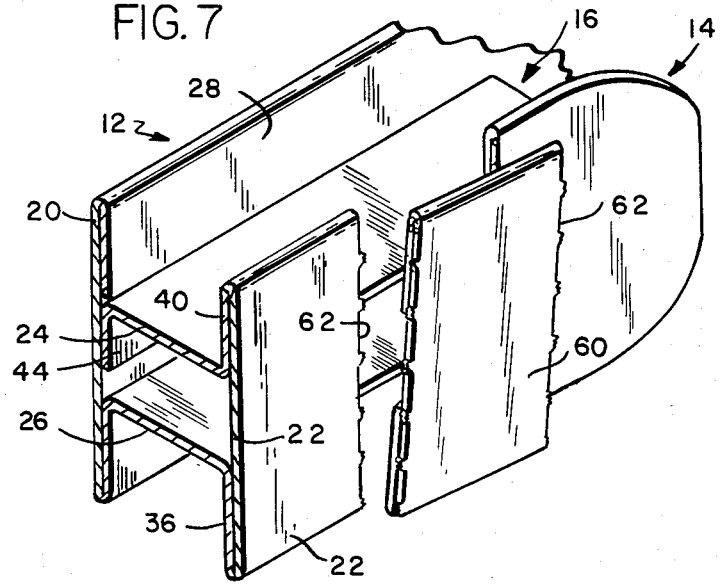

PACKAGING REEL

BACKGROUND OF THE INVENTION

Reels for the storage of ribbon and the like are shown in U.S. Pat. Nos. 1,052,303; 2,477,333; 2,559,056; 2,368,594; 3,104,077; 3,971,527; 3,838,602; and 4,019,692. Such reels as are shown in the aforesaid patents are of complicated construction; hence, they are uneconomical to manufacture and not economical of material. It is the purpose of this invention to provide an improved reel construction wherein a minimum amount of sheet material is required for its manufacture, wherein the side walls are reinforced, but of no more than two ply thickness to thus maintain minimum wall thickness without sacrifice of wall stiffness, wherein the structure is collapsible, and wherein there is provided a removable reorder tab.

SUMMARY OF THE INVENTION

As herein illustrated, the reel comprises spaced, parallel first and second flanges of corresponding configuration and a hub positioned between said first and second flanges, said first and second flanges comprising first and second outer side wall panels and said hub comprising spaced, parallel first and second longitudinal hub panels spaced inwardly from the edges of said first and second outer side wall panels, said longitudinal hub panels being positioned at right angles to the first and second outer side wall panels and being shorter than said first and second outer side wall panels such that the ends of said first and second longitudinal hub panels are spaced inwardly equidistantly from the opposite ends of said first and second outer side wall panels, said first and second longitudinal hub panels defining, in conjunction with said first and second outer side wall panels, a channel between the first and second outer side wall panels within which to confine a ribbon-like material to be stored thereon and said reel comprises a first reinforcing panel integrally connected at one edge to an edge of the first outer side wall panel and extending therefrom to one edge of the first longitudinal hub panel, a second reinforcing panel integrally connected at one edge to the other edge of the first outer side wall panel and extending therefrom to the one edge of the second longitudinal hub panel, hinge means integrally connecting the other edge of the second reinforcing hub panel to said one edge of the second longitudinal hub panel, a third reinforcing panel integrally connected at one edge to the second outer side wall panel and extending therefrom to the other edge of the second longitudinal hub panel, hinge means integrally connecting the other edge of the third reinforcing hub panel to the other edge of the second longitudinal hub panel, a fourth reinforcing panel integrally connected at one edge to the other edge of the second outer side wall panel and extending therefrom to the other edge of the first longitudinal hub panel, hinge means integrally connecting the other edge of the fourth reinforcing panel to the other edge of the first longitudinal hub panel and a glue strip hingedly connected to the other edge of the first longitudinal hub panel and adhered to the inner side of the first outer side wall panel intermediate the first and second longitudinal hub panels, said panels being comprised of a single sheet of cardboard appropriately folded to dispose the reinforcing panels at the inner side of the first and second outer side wall panels and the first and second longitudinal hub panels at right angles to the first and second outer side wall panels and said reinforcing panels being adhesively bonded to the inner sides of the first and second outer side wall panels throughout their areas of contact with the inner sides of the first and second outer side wall panels. The first and third reinforcing panels have at their opposite ends extensions corresponding in length to half the distance between the length of the first and second outer side wall panels and the first and second longitudinal hub panels and corresponding in width to the distance between the first and second longitudinal hub panels adhered to the inner sides of the first and second side wall panels. There are end hub panels hingedly connected at one end, to the opposite ends of one of the first and second longitudinal hub panels corresponding in width to the distance between the first and second outer side wall panels and in length to the distance between the first and second longitudinal hub panels disposed at right angles to the first and second longitudinal hub panels. The reel is collapsible to dispose the second longitudinal hub panel against the inner side of the second outer side wall panel, the first outer side wall panel against the second longitudinal hub panel, and the first outer side wall panel against the first longitudinal hub panel. When folded, the hub panels are disposed against the second outer side wall panel. There is a reorder tab incorporated in one of the outer side wall panels detachable therefrom when the reel is empty defined by spaced, parallel lines of weakness extending from edge-to-edge of the side wall panel separable from the outer side wall panel by tearing along the lines of weakness. The lines of weakness may be provided by perforations.

The invention will now be described in greater detail with reference to the accompanying drawings, wherein:

FIG. 5 is a longitudinal section taken on the line 5—5 of FIG. 1;

FIG. 6 is a diagrammatic view of the reel collapsed;

FIG. 7 is a fragmentary perspective showing the reorder tab removed from the reel;

FIG. 8 is a plan view of the blank of which the reel is comprised;

Figure 1:
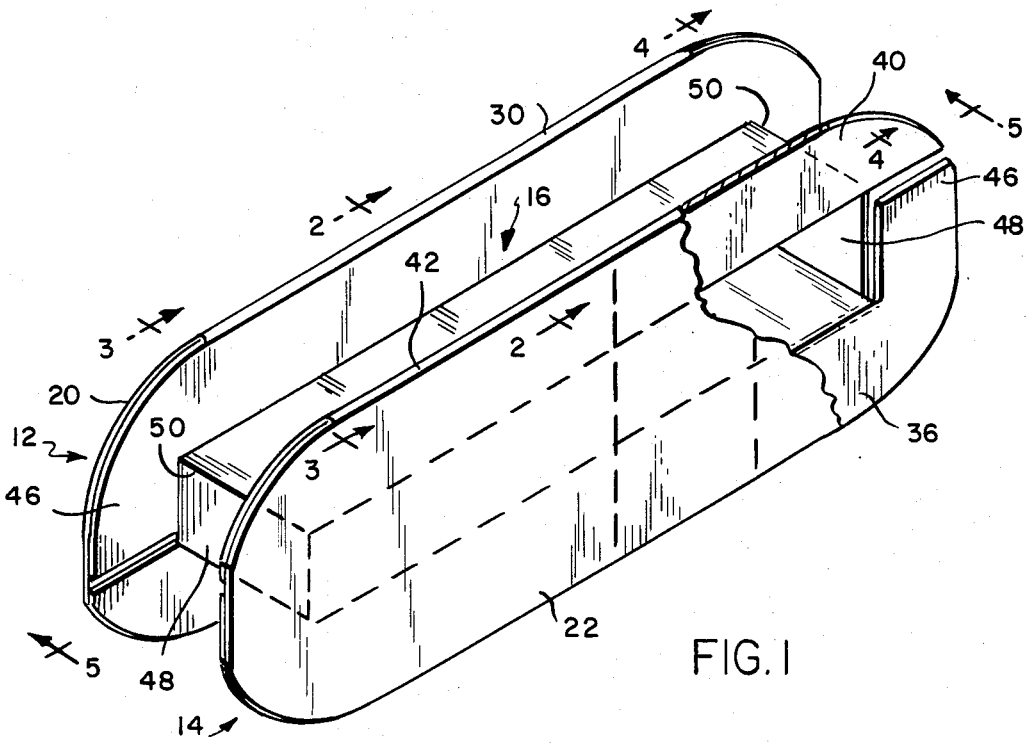
FIG. 1 is a perspective view of the reel.
Figure 2:
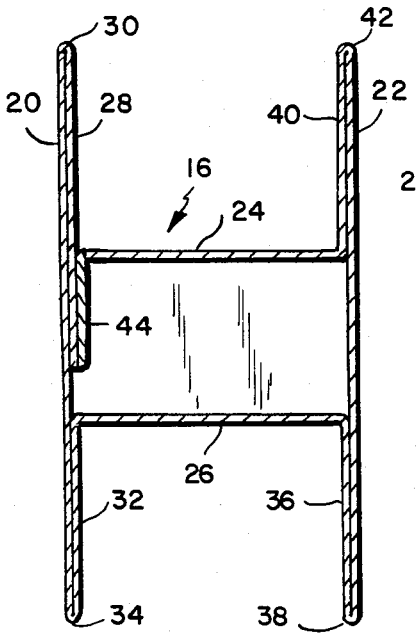
FIG. 2 is a transverse section taken on the line 2—2 of FIG. 1.
Figure 3:
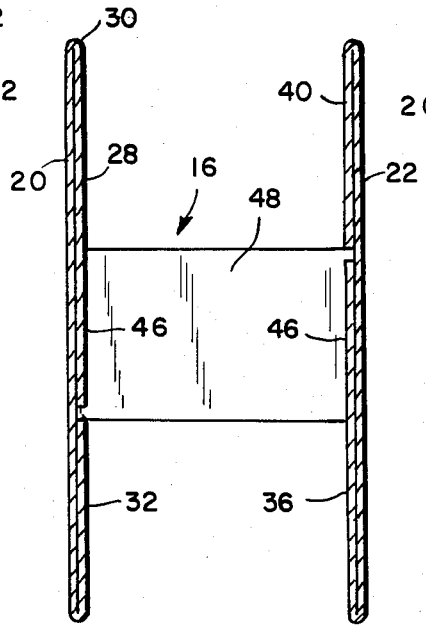
FIG. 3 is a transverse section taken on the line 3—3 of FIG. 1.
Figure 4:
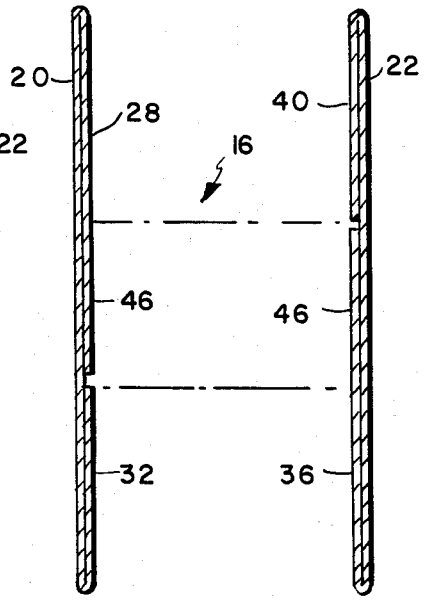
FIG. 4 is a transverse section taken on the line 4—4 of FIG. 1.

Referring to the drawings, the reel as herein illustrated comprises spaced, parallel flanges 12 and 14 which are of corresponding configuration in length and width between which is positioned a hub 16 which is shorter in length than the flanges 12 and 14 and shorter in depth than the width of the flanges 12 and 14 positioned between the flanges 12 and 14 equidistantly from opposite ends thereof and equidistantly from opposite edges thereof so as to define therewith a continuous channel 18 longitudinally of and about the end of the reel for receiving for storage a ribbon-like material.

As herein illustrated, the flanges 12 and 14 are comprised of two-ply construction, a first outer side wall panel 20 and a second outer side wall panel 22 spaced from and parallel to the first side wall panel 20 between which is positioned the hub 16 which comprises first and second hub panels 24 and 26. The longitudinally-disposed hub panels 24 and 26 are of shorter length than the length of the outer side wall panels 20 and 22 and are positioned between the outer side wall panels 20 and 22 equidistant from the opposite ends thereof and equidistant from the opposite edges thereof and are supported and connected thereto by reinforcing panels comprising a first reinforcing panel 28, integrally connected and hinged by hinge means 30 to one edge of the first outer side wall panel 20 and extending inwardly therefrom to the first longitudinal hub panel 24 and being adhesively bonded to the inner side of the first outer side wall panel 20. There is a second reinforcing panel 32 integrally connected by hinge means 34 to the opposite edge of the outer side wall panel 20 and extending therefrom to the second longitudinal hub panel 26 and adhesively bonded to the inner side of the first outer side wall panel 20. There is a third reinforcing panel 36 integrally connected by hinge means 38 to one edge of the second outer side wall panel 22 and extending inwardly therefrom to the second longitudinal hub panel 26 and adhesively bonded to the inner side of the second outer side wall panel 22. There is a fourth reinforcing panel 40 integrally connected at one edge to the other edge of the second outer side wall panel 22 by hinge means 42 and extending inwardly therefrom to the first longitudinal hub panel 24 and adhesively bonded to the inner side of the second outer side wall panel 22. There is a tab 44 integrally connected to the opposite edge of the first longitudinal hub panel 24 by hinge means 46 disposed in parallel relation to the inner side of the first reinforcing panel 28 and adhesively bonded thereto between the first and second longitudinal hub panels 24 and 26.

The first reinforcing panel 28 has at its opposite end end portions 46—46 corresponding in length to one-half the difference between the length of the longitudinal hub panels and the outer side wall panels and in length to the distance between the longitudinal side wall panels adhered to the inner sides of the outer side wall panels at opposite ends of the hub panels. Correspondingly, the third reinforcing panel 36 has end portions 46—46 at its opposite ends corresponding to the difference in length between the longitudinal hub panels and the outer side wall panels and in length to the distance between the longitudinal hub panels adhered to the inner side of the second outer side wall panel at the opposite ends of the hub.

At opposite ends of one of the longitudinal hub panels 24,26, there are end hub panels 48 hingedly connected by hinge means 50—50 to the opposite ends of one of the longitudinal hub panels corresponding in length to the distance between the longitudinal hub panels and in width to the distance between the outer side wall panels disposed at right angles to the longitudinal hub panels and the outer side wall panels. When the reel is erected, the end hub panels are disposed at right angles to the longitudinal hub panels and the side wall panels and by frictional engagement with the latter, hold the side wall panels at right angles to the longitudinal hub panels.

As thus constructed, the reel can be collapsed for shipping purposes, as shown in FIG. 6, with the second side wall panel 22 disposed at the bottom, the second longitudinal hub panel 26 engaged with the inner side of the second side wall panel, the first longitudinal hub panel 24 disposed against the second longitudinal hub panel 26 and the first outer side wall panel 20 disposed against the first longitudinal hub panel 24. In this collapsed position, the end hub panels 48—48 will be disposed in engagement with the inner surface of the second outer side wall panel.

In accordance with another aspect of the invention, a reorder tab 60 is removably embodied in one of the flanges so as to be removable therefrom herein illustrated in the second flange 14. The reorder tab 60 is defined by spaced, parallel lines of weakness 62—62 extending from one edge to the other edge of the second outer side wall panel and from the outer edges of the third and fourth reinforcing panels to the first and second longitudinal hub panels. The lines of weakness 62—62 are, in this instance, perforations. The lines of perforation enable tearing the reorder tab 60 from the reel when the latter becomes empty for reorder purposes.

The blank of which this reel is comprised, FIG. 7 is formed of one sheet of suitable cardboard, die-cut to form the respective panels, and the hinges connecting the same which enables folding it in the form described above with a minimum use of material to provide not only a structure wherein the flanges are of no more than two-ply thickness, but one which is collapsible for shipping purposes and, further, to provide for the reorder tab. As shown in FIG. 7, the blank comprises the first outer side wall panel 20, the second outer side wall panel 22, the first longitudinal hub panel 24, the second longitudinal hub panel 26, the first reinforcing panel 28, the second reinforcing panel 32, the third reinforcing panel 36 and the fourth reinforcing panel 40. The panels are horizontally centered by hanger means. The tab 44 is hingedly connected to the first longitudinal hub panel 26 by hinge means. The end hub panels 24—24 are connected to the opposite ends of the first longitudinal hub panel 26. The reorder tab is formed in the outer side wall panel 22 and reinforcing panels 26,36 by lines of weakness 62—62.

Figure 9:
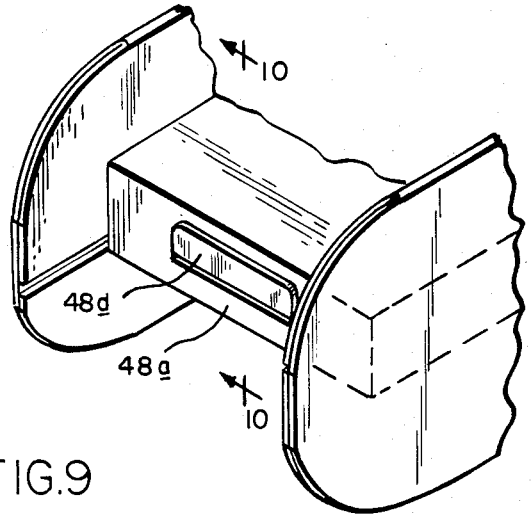
FIG. 9 is a fragmentary perspective of the reel provided with a modified hub end structure.
Figure 10:
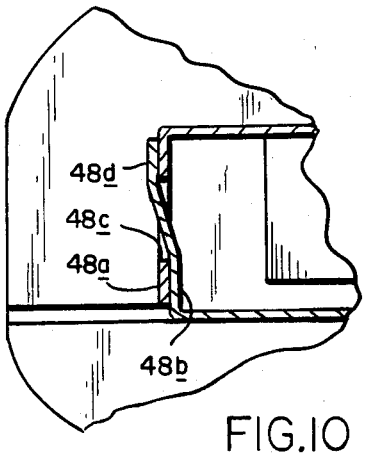
FIG. 10 is a section taken on the line 10—10 of FIG. 9.
Figure 11:
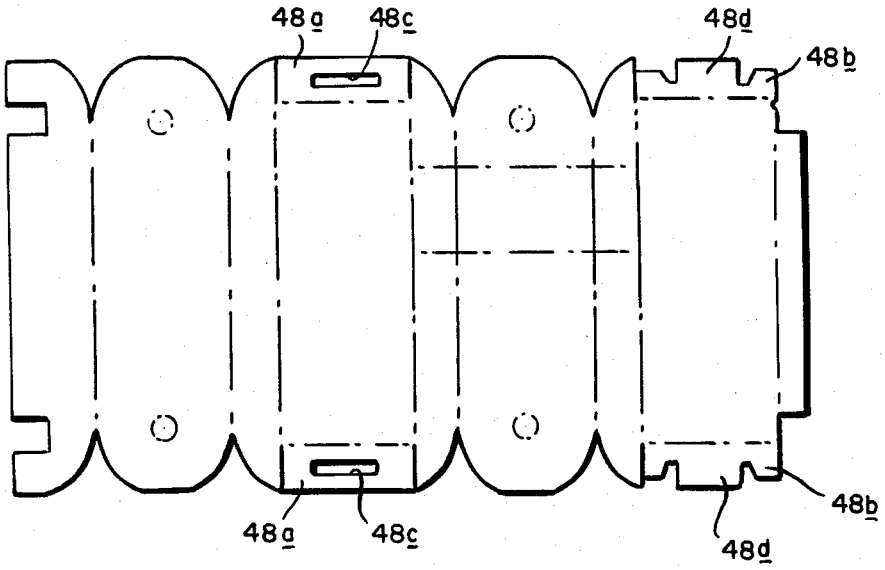
FIG. 11 is a plan view of the blank of FIGS. 9 and 10.

FIGS. 9, 10 and 11 show a modification of the reel wherein the opposite ends of the hub 16 are provided with interlocking end hub panels **48*c*–48*b*. As illustrated in FIG. 10, the end panel 48*c* contains a slot 48*c* for receiving a tab 48*d*. In all other respects, the construction of the reel shown in FIGS. 9, 10 and 11 is the same as that shown in FIGS. 1 to 8** inclusive.

The reel constructed of a single die-cut blank as described is economical with respect to the amount of material required, provides a rigid structure of no more than two ply thickness, is collapsible for shipping purposes, easily set up for use and embodies a reorder tab easily separable therefrom when the reel is empty.

It should be understood that the present disclosure is for the purpose of illustration only and includes all modifications or improvements which fall within the scope of the appended claims.

What is claimed is:

1. A reel comprising spaced, parallel first and second outer side wall panels of corresponding configuration and a hub positioned between said first and second side wall panels comprising spaced, parallel first and second longitudinal hub panels spaced inwardly from the edges of said first and second outer side wall panels, said longitudinal hub panels being positioned at right angles to the first and second outer side wall panels and being shorter than said first and second side wall panels such that the ends of said first and second longitudinal hub panels are spaced inwardly equidistantly from the opposite ends of said first and second outer side wall panels, said first and second longitudinal hub panels defining, in conjunction with said first and second outer side wall panels, a channel between the first and second outer side wall panels within which to confine ribbon-like material to be stored thereon and said reel comprising a first reinforcing panel integrally connected at one edge to an edge of the first side wall panel and extending therefrom to one edge of the first longitudinal hub panel, a second reinforcing panel integrally connected at one edge to the other edge of the first outer side wall panel and extending therefrom to one edge of the second longitudinal hub panel, hinge means integrally connecting the other edge of the second reinforcing hub panel to said one edge of the second longitudinal hub panel, a third reinforcing panel integrally connected at one edge to the second outer side wall panel and extending therefrom to the other edge of the second longitudinal hub panel, hinge means integrally connecting the other edge of the third reinforcing hub panel to the other edge of the second longitudinal hub panel, a fourth reinforcing panel integrally connected at one edge to the other edge of the second outer side wall panel and extending therefrom to the other edge of the first longitudinal hub panel, hinge means integrally connecting the other edge of the fourth reinforcing panel to the other edge of the first longitudinal hub panel and a glue strip hingedly connected to the other edge of the first longitudinal hub panel and adhered to the inner side of the first outer side wall panel intermediate the first and second longitudinal hub panels, said panels being comprised of a single sheet of cardboard appropriately folded to dispose the reinforcing panels at the inner sides of the first and second outer side wall panels and the first and second longitudinal hub panels at right angles to the first and second outer side wall panels and said reinforcing panels being adhesively bonded to the inner sides of the first and second outer side wall panels throughout their area of contact with the inner sides of the first and second outer side wall panels.

2. A reel according to claim 1 wherein the first reinforcing panel has at its opposite ends end portions corresponding in length to half the distance between the length of the first and second outer side wall panels and the first and second longitudinal hub panels and corresponding in width to the distance between the first and second longitudinal hub panels adhered to the inner sides of the first and second side wall panels.

3. A reel according to claim 1 wherein the third reinforcing panel has at its opposite ends end portions corresponding in length to half the distance between the length of the first and second outer side wall panels and the first and second longitudinal hub panels and corresponding in width to the distance between the first and second longitudinal hub panels adhered to the inner sides of the first and second side wall panels.

4. A reel according to claim 1 comprising end hub panels hingedly connected at one end to one of the first and second longitudinal hub panels corresponding in width to the distance between the first and second outer side wall panels and in length to the distance between the first and second longitudinal hub panels disposed at right angles to the first and second longitudinal hub panels in frictional engagement with the inner sides of the outer side wall panels.

5. A reel according to claim 1 wherein the reel is collapsible to dispose the second longitudinal hub panel against the inner side of the second outer side wall panel, the first outer side wall panel against the second longitudinal hub panel and the first outer side wall panel against the first longitudinal hub panel.

6. A reel according to claim 5 wherein the hub panels are disposed against the second outer side wall panel.

7. A reel according to claim 1 comprising a reorder tab incorporated in one of the flanges of the reel detachable from the flange when the reel is emptied.

8. A reel according to claim 1 comprising a reorder tab embodied in the second outer side wall panel of one of the flanges defined by spaced, parallel lines of weakness extending from edge-to-edge of the outer side wall panel, said reorder tab being separable from said second outer side wall panel.

9. A reel according to claim 8 wherein the line of weakness extends from the opposite edges of the outer side wall panel to the inner edge of the reinforced panel at the inner sides of the flanges.

10. A reel according to claim 8 wherein the lines of weakness are constituted by perforations.

11. A reel according to claim 4 comprising end hub panels hingedly connected at the ends of the first and second longitudinal hub panels, the end hub panels of each of the hub panels being interengageable.

12. A reel according to claim 11 wherein one of the end hub panels contains a slot and the other a tongue interengageable with the slot.

* * * * *